United States Patent [19]

Meltzer et al.

[11] Patent Number: 4,543,549

[45] Date of Patent: Sep. 24, 1985

[54] MULTIPLE CHANNEL ROTARY JOINT

[75] Inventors: Leonard A. Meltzer, Little Neck; Seymour Sutkin, Huntington Station, both of N.Y.

[73] Assignee: United Technologies Corporation, Hartford, Conn.

[21] Appl. No.: 576,848

[22] Filed: Feb. 3, 1984

[51] Int. Cl.[4] ..... H01P 1/06

[52] U.S. Cl. ..... 333/256; 333/24 C; 343/763

[58] Field of Search ..... 333/256, 257, 261, 1, 333/24 C; 343/758, 762, 763

[56] References Cited

U.S. PATENT DOCUMENTS

| | | | |
|---|---|---|---|
| 3,123,782 | 3/1964 | Parisi | 333/257 |
| 4,117,426 | 9/1978 | Hudspeth et al. | 333/257 |
| 4,233,580 | 11/1980 | Treczka et al. | 333/261 |
| 4,327,334 | 4/1982 | Becavin et al. | 333/256 X |

FOREIGN PATENT DOCUMENTS

| | | | |
|---|---|---|---|
| 445090 | 12/1974 | U.S.S.R. | 333/261 |

*Primary Examiner*—Paul Gensler

*Attorney, Agent, or Firm*—Robert P. Sabath

[57] ABSTRACT

A modular matrixed cylindrical rotary joint for transferring channeled electromagnetic energy from the stationary part of a radar system to its rotatable portion and an inner modular stator which supports the outer portion on redundant bearing modules.

5 Claims, 9 Drawing Figures

MULTIPLE CHANNEL ROTARY JOINT

DESCRIPTION

1. Technical Field

This invention relates to a multiple channel rotary joint in radar systems, and more particularly relates to a multiple channel rotary joint for use in radar systems employing a rotating array antenna.

2. Background Art

Presently, in conventional radar systems employing rotary array antennas, the rotary joints effective for coupling electromagnetic power to the antenna employ a complex modular rotary joint requiring a single module per channel. Each module requires several supporting bearings for effective operation. This, of course, results in a large total number of bearings for the combined modular assembly, which may contain about 23 channels.

Even more critical is that the failure of a single bearing incapacitates the entire modular assembly and renders the radar inoperable.

This is unacceptable because it places out of commission a complex, heavy piece of equipment, which is quite expensive to replace of maintain.

Accordingly, it is an object of this invention to construct a multichannel rotary joint involving assembly along a common axis and utilizing a minimum number of rolling-element bearings.

It is another object of the instant invention to establish a multiple-channel rotary joint for radar application, which greatly reduces the number of rolling-element bearings required.

It is a further object of the present invention to minimize, reduce or diminish complexity, weight and cost in the making of a multichannel rotary joint used in radar systems.

It is a further object to establish a cylindrical multichannel rotary joint for radar application, which makes braces unnecessary, as the cylindrical structure is self-supporting and structurally stiff.

It is a further object of the invention to establish a thin-walled cylindrical multichannel rotary joint for radar application, which is light in weight.

It is another object to provide for separate bearing and power modules, in order to minimize heating of the ball bearings and thereby to extend their operational life span.

Another object of the instant invention is simplification of design and the enablement of manufacture of multichannel rotary joints for radar application by boring machines effective for inherently being capable of producing accurate concentricity and squareness, whereby production economies are enhanced.

DISCLOSURE OF INVENTION

The invention herein is directed toward a simplified multichannel rotary joint including a matrix of bearing and power transfer modules for radar application, which is assemblable along a common axis, but which eliminates the need for bearing support at the stage of each separate module. This improved rotary joint is comprised of cylindrical portions and employs stator and rotor elements combining to constitute the complete assembly. The device includes respective male and female pilot surface diameters at the opposite ends of each module. The outer or rotor elements are for example bolted at flanges, and the inner or stator elements are equipped with splines or key ways, in a preferred embodiment, permitting the transmission of torque from module to module.

Axial preload is provided by a wave washer or spring element. Adjacent module rotors and stators are alternately stacked. Mating pilot surface diameters maintain the modules in concentric relationship and square to the common axis of the rotary joint.

Additional stability is offered by a central radial bearing module, which is also equipped with piloted rotors and stators. The central radial bearing module may be positioned adjacent the mounting ring of the rotary joint.

Static O-ring seals positioned in annular recesses or on the male pilot surfaces of the respective modules effectively prevent the leakage of air or gas dielectric from the assembly.

A dynamic seal is at the bottom of the rotary joint and serves the same sealing purpose. Lip or mechanical seals may be substituted to serve this function, which prevents air or gas leakage between the stator and rotor portions of the lowest module.

Accordingly, each power module, whether provided with direct or indirect bearing support is effective for the transmission of electromagnetic power between coaxial cable leads of the radar system. Moreover, the power modules and bearing modules are separate, which minimizes the heating of the ball bearings and extends their life span.

BRIEF DESCRIPTION OF DRAWINGS

The invention will be better understood from the following description taken in conjunction with the accompanying drawing, wherein.

BEST MODE FOR CARRYING OUT THE INVENTION

Figure 1:
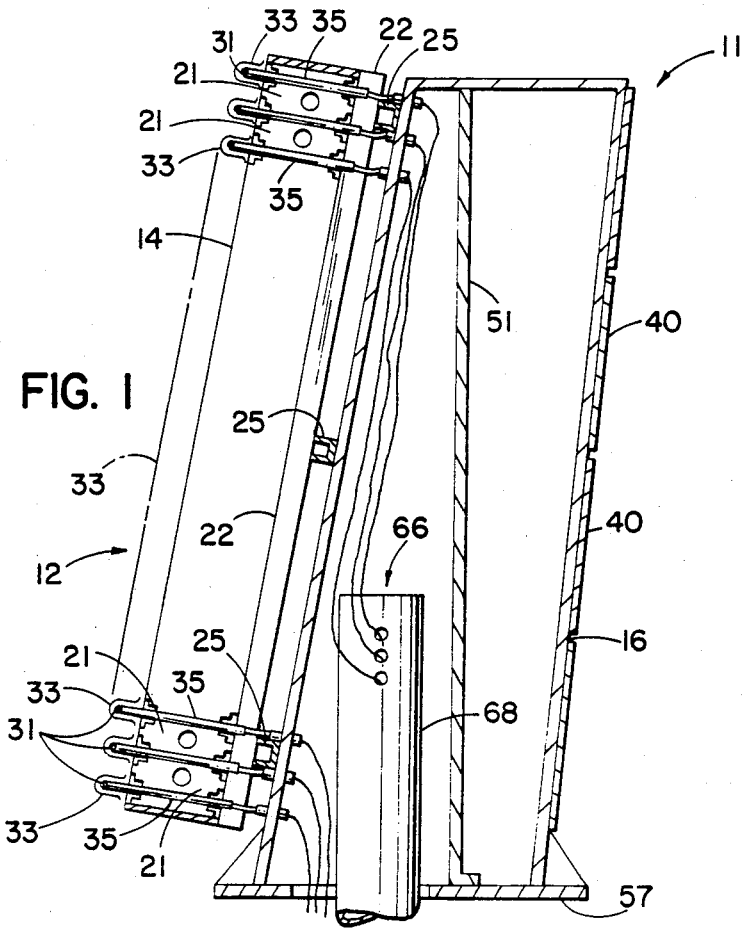
FIG. 1 shows a vertical cross-section of an upper part of the structure of an array radar system, including a rotary joint having an upper outer portion for rotating with the array antenna and having coaxial leads coupled directly to the row power dividers of the array antenna, and further including an inner lower portion more completely shown in the Figures below.

FIG. 1 shows a portion of an array-type radar 11 system structure including an antenna array 12 having a ground plane 14, and a support structure 16. The array 12 is held to the support structure 16 by vertical stiffeners 21 connected to vertical support beams 22 and by horizontal truss members 25. The antenna shown includes 760 dipoles 31 mounted on array form and covered by, for example, 20 radomes 33, and an equal number of row power dividers 35. The vertical stiffeners 21 effectively position the row power dividers 35. The radar system further includes access covers 40, an armored cable conduit 51 and a turntable 57. Rotary joint 66 feeds the row power dividers 35, as shown in FIG. 1.

Figure 2:
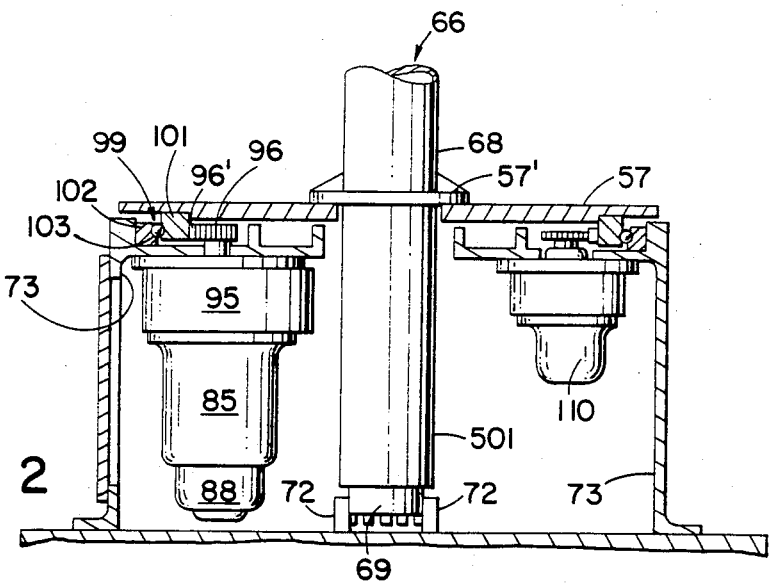
FIG. 2 shows cross-sectionally the support pedestal for the radar as well as details of the lower portion of the rotary joint.

FIG. 2 shows the rotary joint 66 including rotor and stator portions, respectively 68 and 69. The rotor portion 68 is suitably, for example bolt-mounted on turntable 57 with flanges 57'. The stator portion 69 is suitably mounted as for example with brackets 72 on a nonrotating portion of the assembly such as pedestal 73, or an extension thereof such as for example the floor below. The stator portion 69 could in one version be fixed with respect to the surface on which the pedestal 73 rests.

A motor, such as for example the AC motor 85 shown in FIG. 2, which is subject to stoppage by brake 88, is effective for rotating turntable 57 through gear box 95 and gear teeth 96. Gear teeth 96 engage cooperative ball gear 96' on the inner circumference of ball bearing assembly 99, which includes inner and outer races 101 and 102 with spaced ball bearings 103 therebetween. One or more train data units 110 preferably monitor the position of turntable 57.

Figure 3:
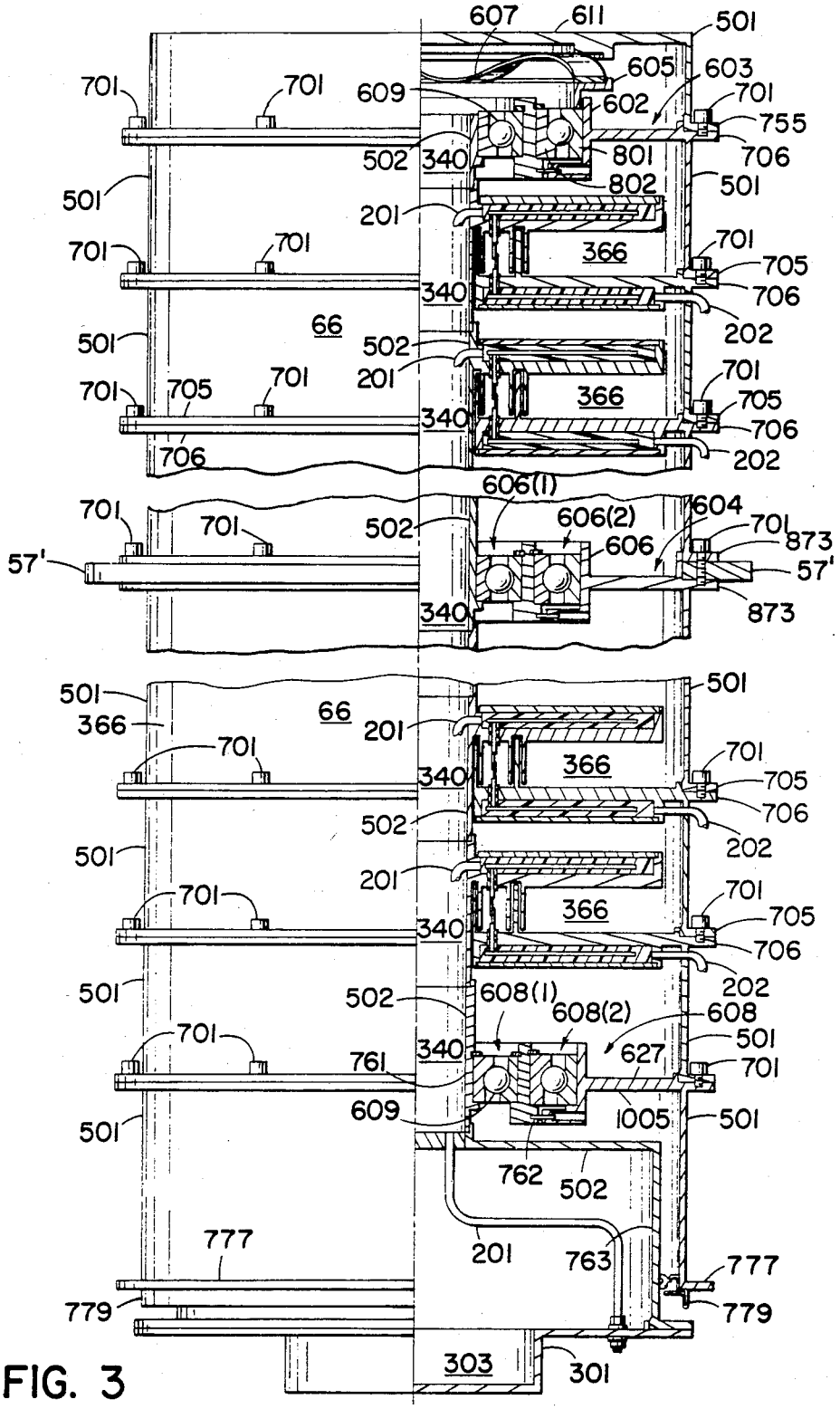
FIG. 3 shows the rotary joint in partial cross section, including both the generally inner stator portion best depicted in the right-hand portion of the Figure, and the outer rotary portion of the rotary joint.

FIG. 3 shows a partial axial cross section of multichannel rotary joint 66. In this embodiment, the joint 66 includes 23 separate feed channels, each including coaxial input and output leads, respectively 201 and 202. Each input lead 201 is for example suitably coupled for transfer of electromagnetic radiation through circular baseplate 301 as for example by bolting portion. Base plate 301 includes a lower compartment 303 for convenience in maintenance. Additionally, rotary joint 66 defines a central duct 340 on the interior through which leads 201 pass. Each lead 201 feeds into its own corresponding power transfer module 366, and each power transfer module 366 in turn has a coaxial power output lead 202, which is coupled to a corresponding row power divider 35, as shown in FIG. 1.

The central duct 340 is defined by the inner walls of the power transfer and bearing modules comprising rotary joint 66 and more particularly by the inner walls of the stator portions of the respective modules.

In particular, FIG. 3 shows the modular rotary joint device 66 including outer rotor casing modules 501 which are rotatable, and inner stator module portions 502 which are fixed in a nonrotating reference frame, for example mounted fixedly with respect to pedestal 73 by brackets 72, as shown in FIG. 2. The sections of rotor casing modules 501 are suitably (in this case by nuts and bolts acting upon adjacent flanges of the respective modules) coupled to each other. The stator modules 502, on the other hand, are preferably spline connected to impede rotation of one stator module 502 with respect to the next. The spline connections on the interior are preferred to nut and bolt connections because of the limited interior space and the difficulty involved in working with inner assemblies involving nut and bolt structures. Alternately, the stator module elements are provided with mating pilot and flange surfaces which may be bolted together.

As can be noted by viewing FIG. 3, the rotor casing 501 actually hangs upon the inner stator portion 502 on ball bearing assemblies 602 of upper bearing module 603.

In addition, a middle bearing module 604 including ball bearing assemblies 606 is shown. This middle module 604 is optional but nonetheless contributes signficantly to stability. Finally, a lower bearing module 627 including ball bearing assemblies 608 is shown in FIG. 3.

The loading on the respective bearing assemblies in these modules is complex. For example, downloading of the upper bearing module 603 occurs by action of a wave spring 607 bearing against the upper bearing module cover 611 and bearing assembly 602 through annular ring piece 604. Furthermore, loading on the lower bearing module 627 can be effected by tightening the rotor modules 501 together as by bolts 701 tightened on upper and lower flanges, respectively 705 and 706.

Stacked between the upper and lower bearing modules are a selected number of power transfer modules 366 which capacitively couple radar power between the respective coaxial leads 201, 202 of each power module 366.

As will be seen, only one bearing subassembly is needed in each bearing assembly 602, 606 or 608 as the case may be, to perform one portion of the invention; however, having two bearing subassemblies enhances the reliability of the rotary junction 66, since when one subassembly breaks down, the other replaces it in functional operation.

The outer bearing subassembly 608(2) of the lower bearing module 627, for example, belongs to the rotor portion 502 of the rotary joint 66 and is non-operational unless the inner bearing subassembly 608(1) freezes or locks, causing pin 762 to sheer.

Figure 4:
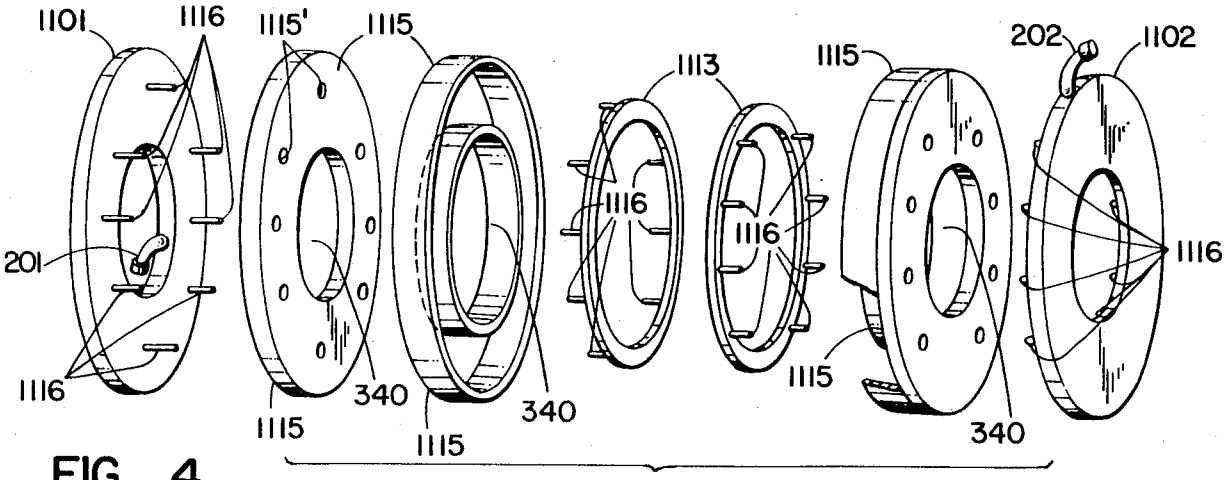
FIGS. 4 and 5 respectively show the respective ring elements of a single power transfer module, first in exploded view and then in assembled axial cross section.
Figure 5:
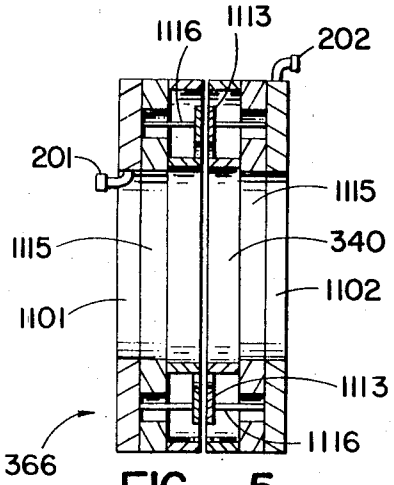

FIGS. 4 and 5 respectively show the capacitive coupling rings 1113 which are found in each power transfer module 366 to effect power transfer for a single channel. These rings 1113 may extend axially to perform capacitive coupling in cylindrical fashion as shown, or radially to perform disc capacitive coupling to effect power transfer as will be discussed. The rings (cylindrical or disc shaped as the case may be) act in cooperative pairs, one associated with the rotor portion of the power transfer module 366 and the other with the stator portion of the particular power transfer module 366. Thus, the voltages on a particular input coaxial line 201 are transmitted in time and in phase to a corresponding one of the output coaxial lines 202.

FIGS. 4 and 5 show another version of the power transfer module 366 in respective exploded and schematic views of ring or annular elements effective to perform a capacitive power coupling. Both views show stator and rotor plates, respectively 1101 and 1102. Coaxial input lead 201 couples into stator power divider plate 1101; coaxial ouput lead 202 couples into rotor combiner plate 1102. The plates 1101 and 1102 respectively act as power dividers or power combiners as the case may be with respect to cooperative suitably insulated feed-throughs 1116 effective for power charging or discharging capacitor coupling rings 1113 which perform energy transmission by adjacently disposed rotation.

Each power combiner plate 1101 or 1102 contains a sandwiched circuit arrangement which acts to distribute the coaxially delivered power signal over the surface of the capacitive coupling ring 1113 through feed-throughs 1116. In this case, the coupling ring is annular and disc-shaped, although it could in the alternative be cylindrical. In the cylindrical case, the two capacitive coupling rings 1113 would be nested within one another, one having a slightly smaller diameter than the other.

The power transfer module 366 includes ground plates 1115 defining circumferentially spaced apertures 1115' to receive feed-throughs 1116 leading to the capacitive coupling rings 1113. The respective ground plates 1115 limit the electromagnetic power level to the region of capacitive coupling rings 1113 and prevent electromagnetic leakage from rotary joint 66 or into the central duct 340. Feed-throughs 1116 from the respective power plates 1101, 1102 to the corresponding capacitive coupling rings 1113 are suitably electrically insulated from the ground plate 1115.

Figure 6:
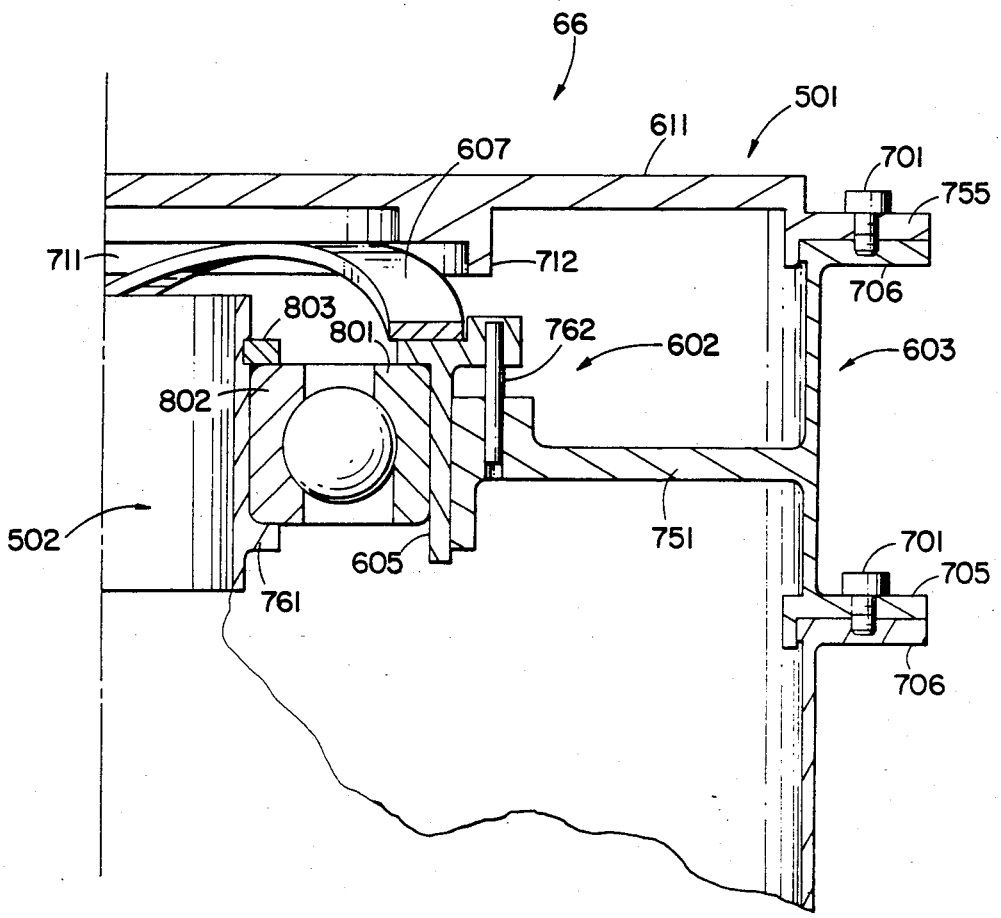
FIG. 6 is a detail of a bearing module of the rotary joint, which in this case is a version of an upper bearing module which employs one rather than two bearing assemblies.

FIG. 6 shows one version of the upper bearing module 603 for the rotary joint 66. An annular recess 711 with outer flange 712 holds wave spring 607 in place, enabling it to apply a holding force on a central annular piece 605 and against an outer annular flanged piece 751 which can for example be bolted at its outer flange 706 with the rotor top piece 611 at its own flange 755 by bolt 701. An inner ring piece 761 holds the inner race 802 of the bearing assembly 602 in place in conjunction with retaining ring 803.

Figure 7:
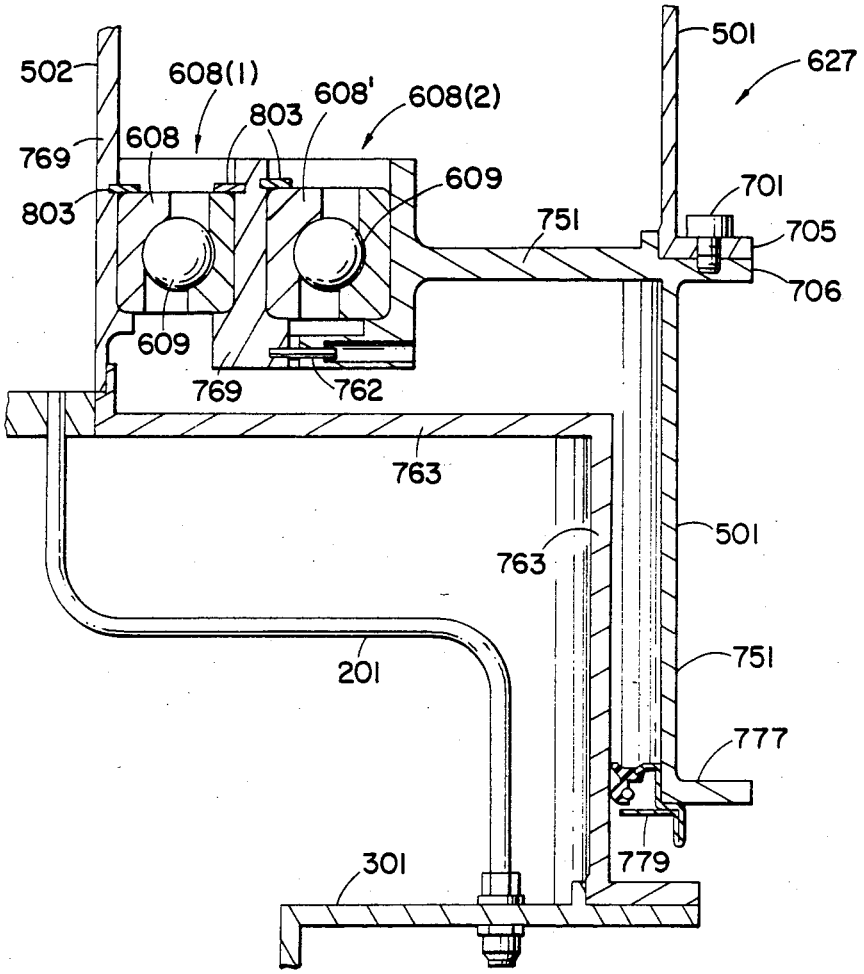
FIG. 7 provides a detail view of another bearing module of the rotary joint, this time showing a version of a lower bearing module including two bearing assemblies.

FIG. 7 shows the lower bearing module 627 with annular piece 769 pin latched to outer wall piece 751 by shear pin 762. The lower flange 777 of outer piece 751 is dynamically sealed against stator wall 763 with a suitable dynamic seal 779. Central annular piece 761 supports an inner bearing assembly 608(1). The bearing race overhang 608' with respect to bearing 609 indicates an upward holding force being applied by the outer rotor assembly 501 with respect to the inner stator assembly 502.

The lower bearing module 627 is subject to preloading forces established by wave spring 607 (FIG. 6) and the tightness with which the individual rotary modules are connected as with bolts 701 on the flanges 705, 706.

The respective bearing subassemblies 608(1) and 608(2) are locked into place by retaining rings 803. Annular sliding pilot joints are provided between respective stator-to-stator and rotor-to-rotor modules to facilitate aligned axial construction. Adjacent modules are pilot jointed and splined, keyed or bolted as the case may be to establish unitary cooperation between respective rotary and respective stator modules, so that effective operation of the rotary joint 66 is achieved.

Figure 8:
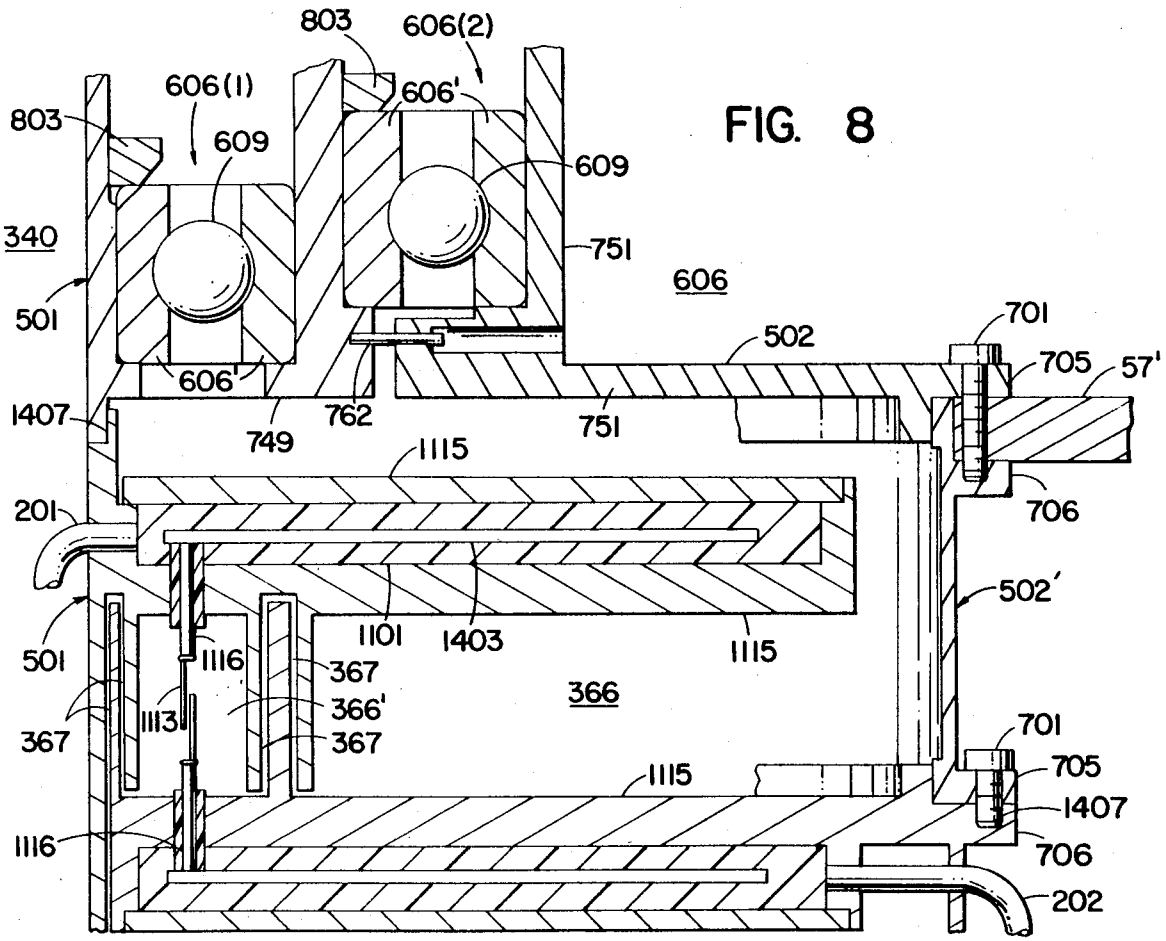
FIG. 8 shows a partial axial cross section of a power transfer module and an optional central bearing module.

FIG. 8 shows a version of the central bearing module 606. The bearing subassemblies 606(1) and 606(2) are shown constructed for side loading, as can be seen by noting the symmetrical overhang of the respective races 606' with respect to the balls 609 themselves. The outer bearing assembly 606(2) is inoperative initially and is locked into place by shear pin 762. Accordingly, the outer bearing assembly 606(2) belongs directly to the rotary outer portion 502 of the center bearing module 606, although it is potentially subject to realignment with the stator portion 501 of the module by mere breaking of the shear pin 752. The outer bearing assembly 606(2) accordingly serves in reserve awaiting malfunction of the inner bearing assembly 606(1), as might occur by its freezing or latching into place. This would cause a shearing event with respect to shear pin 762 and activation of the outer bearing assembly 606(2).

As can be seen, each bearing subassembly includes outer and inner races with ball bearings 609 suitably disposed in respective ring depressions fashioned on the respective inner and outer surfaces of the respective races.

The ball bearing races and other structural pieces of the rotary joint 66 are preferably machined, metallic, annular, cylindrical pieces.

The center bearing module 606 of the rotary joint 66 includes such pieces as an outer flanged portion 751 which can conveniently be lathe machined. The center bearing module 606 additionally includes a central annular piece 749 which cooperatively engages said outer flanged portion 751 with shear pin 762. The outer bearing subassembly 606(2) can conveniently be positioned in place between the outer flanged portion 751 and the central annular piece 749. The outer bearing subassembly 606(2) is then held in place by retaining ring 803. Inner bearing subassembly 606(1) is similarly held in place by a retaining ring 803.

FIG. 8 additionally shows a preferred version of the power transfer module 366. As shown, the power transfer module 366 employs an inner annular stator portion 501 and outer annular rotor portion 502. These respectively define a portion of inner duct 340 and outer casing 502'. Respective input and output coaxial leads 201 and 202 are shown.

FIG. 8 additionally shows chambers 366' wherein respective capacitive coupling rings 1113 perform electromagnetic power coupling operation.

For simplicity of illustration, the coupling rings 1113 may be shown in contact. However, in actual operation there is a small space separating the coupling rings 1113 which prevents the flow of electric current therebetween.

The ends of leads 1116 are used to support capacitive coupling rings 1113. The power divider circuitry 1403 is constructed within power plates 1101 as shown. Ground plates 1115 are shown. Coupling chambers 366' with quarter wavelength choke paths 367 are effective to prevent the escape of electromagnetic energy.

Finely machined pilot surfaces 1407 at the various flanges 705 and 706 and inner spline connections are effective for establishing proper alignment between respective annular sections. Accordingly, the modular construction of the rotary joint 66 is correctly aligned with respect to the central axis of the rotary joint 66.

Figure 9:
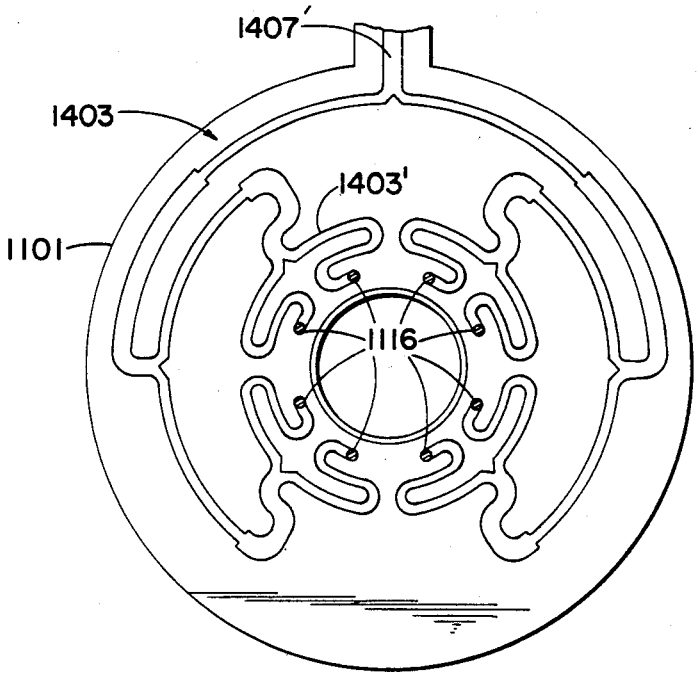
FIG. 9 shows a power divider circuit which distributes the voltage received from a coaxial lead over an annular plate for capacitive power coupling.

FIG. 9 shows a preferred embodiment of the power divider or combiner circuit 1403 including electrically conducting strip circuitry 1403' on a suitable dielectric material such as Teflon, which is a registered trademark of Dupont, as is well known in the art. The center coaxial lead 1407' is suitably repeatedly divided and subdivided in corporate fashion and symmetrically arranged in an insulated serpentine strip pattern ending with circumferentially spaced and separated terminals for connection to feed-throughs 1116 at the interior of power plate 1101.

For more information regarding this technology, see *Stripline Circuit Design* by Harlan Howe, Jr. (Artech House, Dedham, Mass. 1974).

The description above may permit others skilled in the art to develop useful derivations of the preferred embodiment which are clearly part of the inventive content addressed herein. However, the actual scope of the invention goes beyond the preferred embodiment, and it is accordingly useful to refer to the terms and limitations of the claims below.

We claim:

1. A rotary joint arrangement for transferring electromagnetic power in a plurality of channels between stationary and rotatable radar structures, said rotary joint arrangement comprising a cooperative matrix of bearing and power transfer modules each including a stator and rotor portion including respective stationary and rotatable coaxial power leads, and each of said power transfer modules including rotatable means for rotatingly coupling a single channel of electromagnetic power between said respective stationary and rotatable coaxial power leads, said rotary joint arrangement including at least a pair of bearing modules, and at least one of said power transfer modules intervening in position between said pair of bearing modules, whereby said bearing and power transfer modules are interspersed with respect to one another and the rotor portions of said power transfer modules being rotatably supported by the rotor portions of said bearing modules.

2. The method of constructing a cooperative matrix of at least a pair of bearing modules and a selected plurality of power transfer modules each including rotor and stator portions in a rotary joint arrangement for transferring electromagnetic power in selected ones of a plurality of channels between stationary and rotatable structures in a radar system, including the steps of:

interspersedly positioning the rotor and stator portions of said power transfer and bearing modules along a common axis with at least one of said power transfer modules intervening in position between said pair of heating modules;

fixedly connecting the rotor portions of said rotary joint arrangement with the rotatable structure of said radar system;

fixedly connecting the stator portions of said rotary joint arrangement with the stationary structure of said radar system, whereby the rotor portions of said arrangement are rotatably movable on said bearing module with respect to said radar system stationary structure.

3. The invention of of claims 1 or 2, wherein the stator portions of said bearing and power transfer modules are centrally stacked and disposed for rotation thereabout of said rotor portions of said rotary joint arrangement.

4. The invention of claims 1 or 2, wherein at least one of said bearing modules includes a pair of annular bearing assemblies.

5. The invention of claim 4, wherein one of said annular bearing assemblies in held in reserve and is actuable upon failure of the other.

* * * * *